US008641016B2

(12) United States Patent
Tatera

(10) Patent No.: US 8,641,016 B2
(45) Date of Patent: Feb. 4, 2014

(54) CARBONATION DEVICE

(76) Inventor: Patrick J. Tatera, Talkeetna, AK (US)

( * ) Notice: Subject to any disclaimer, the term of this patent is extended or adjusted under 35 U.S.C. 154(b) by 615 days.

(21) Appl. No.: 12/978,386

(22) Filed: Dec. 23, 2010

(65) Prior Publication Data

US 2011/0115103 A1 May 19, 2011

Related U.S. Application Data

(63) Continuation-in-part of application No. 12/591,407, filed on Nov. 18, 2009, now Pat. No. 8,267,007.

(51) Int. Cl.
*B01F 3/04* (2006.01)

(52) U.S. Cl.
USPC ..... 261/62; 261/65; 261/71; 261/DIG. 7; 99/323.1

(58) Field of Classification Search
USPC ..... 261/62, 65, 66, 71, 74, DIG. 7; 99/323.1, 323.2
See application file for complete search history.

(56) References Cited

U.S. PATENT DOCUMENTS

| | | | | |
|---|---|---|---|---|
| 437,318 | A | | 9/1890 | Thackeray |
| 2,073,273 | A | | 3/1937 | Wetstein et al. |
| 2,600,901 | A | | 6/1952 | Meldau |
| 4,316,409 | A | | 2/1982 | Adams et al. |
| 4,458,584 | A | | 7/1984 | Annese et al. |
| 4,482,509 | A | | 11/1984 | Iannelli |
| 4,679,602 | A | | 7/1987 | Hollis et al. |
| 4,867,209 | A | * | 9/1989 | Santoiemmo ..... 141/19 |
| 5,182,084 | A | | 1/1993 | Plester |
| 5,460,846 | A | | 10/1995 | Stumphauzer et al. |
| 5,549,037 | A | * | 8/1996 | Stumphauzer et al. ..... 99/323.1 |
| 5,836,364 | A | | 11/1998 | Burton |
| 6,017,021 | A | * | 1/2000 | Yiu ..... 261/64.1 |
| 6,024,012 | A | * | 2/2000 | Luzenberg, Jr. ..... 99/323 |
| 7,975,988 | B2 | * | 7/2011 | Thomson et al. ..... 261/65 |
| 8,267,007 | B2 | * | 9/2012 | Tatera ..... 99/323.2 |

FOREIGN PATENT DOCUMENTS

GB 2137894 10/1984

* cited by examiner

*Primary Examiner* — Charles Bushey
(74) *Attorney, Agent, or Firm* — Richard C. Litman

(57) ABSTRACT

The carbonation device includes a cap system selectively mounted to the mouth of a liquid container. The cap system includes a cap, a syringe piston reciprocable within the cap, an actuating mechanism for reciprocating the syringe piston, and a reaction vessel selectively attached to the bottom of the cap. The syringe piston includes a storage area to be filled with water by repeated activation of the actuating mechanism. The water from the charged syringe piston discharges into the reaction vessel that has been filled with a preselected amount of reactants to initiate the carbonation reaction. In an alternative embodiment, the carbonation device includes a rotatable control ring to selectively puncture a $CO_2$ cartridge inside the reaction vessel or introduce water into the reaction vessel to initiate carbonation reaction. In both embodiments, the $CO_2$ flows from the reaction vessel into the container to carbonate the beverage contained therein.

12 Claims, 10 Drawing Sheets

CARBONATION DEVICE

CROSS REFERENCE TO RELATED APPLICATIONS

This is a continuation-in-part of my prior application Ser. No. 12/591,407, filed Nov. 18, 2009, now U.S. Pat. No. 8,267,007, which is hereby incorporated by reference in its entirety.

BACKGROUND OF THE INVENTION

1. Field of the Invention

The present invention relates to beverage enhancers, and more specifically to carbonation device for carbonating beverages, particularly home-brew beer, in a relatively short amount of time.

2. Description of the Related Art

One of the basic necessities to any outdoor activity is potable liquid. It is basic to survival and allows the outdoorsman, e.g. backpackers, hunters, hikers and campers, to keep the body hydrated during the physical activity. If the outdoorsman desires carbonated beverages, the outdoorsman is relegated to toting around bottles or cans of pre-carbonated beverages that may add considerable weight and bulk to his or her pack. Majority of the weight and volume is attributed to the water component in the beverages.

A solution for the drawbacks of the above would be to carry a beverage concentrate to which a user may add purified water for a refreshing drink. However, this solution still lacks the effervescent sensation provided by carbonation that many people enjoy.

Another solution involves the use of a complicated cap system for a bottle or container comprising a plurality of mechanical parts and piping for pressurizing and distributing carbonating gas into the liquid. However, this type of system is costly and difficult to clean, mainly due to the complexity and number of parts for the device.

A further solution involves the use of a carbonation tablet that may be dropped into a liquid container to produce the effervescence. This is a quick and easy way to carbonate the liquid, but the resultant product oftentimes includes an aftertaste that may overpower the taste of the potable liquid. Moreover, the chemical reaction may include some unpalatable solid byproducts. Thus, it would be a benefit in the art to provide an efficient and economical device for carbonating potable liquids with minimal adverse effects on the palate.

Thus, a carbonation device solving the aforementioned problems is desired.

SUMMARY OF THE INVENTION

The carbonation device includes a cap system selectively mounted to the mouth of a liquid container. The cap system includes a cap, a syringe piston reciprocable within the cap, an actuating mechanism for reciprocating the syringe piston, and a reaction vessel selectively attached to the bottom of the cap. The syringe piston includes a storage area to be filled with water by repeated activation of the actuating mechanism. The water from the charged syringe piston discharges into the reaction vessel that has been filled with a preselected amount of reactants to initiate the carbonation reaction. In an alternative embodiment, the carbonation device includes a rotatable control ring to selectively puncture a $CO_2$ cartridge inside the reaction vessel or introduce water into the reaction vessel to initiate carbonation reaction. In both embodiments, the $CO_2$ flows from the reaction vessel into the container to carbonate the beverage contained therein.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
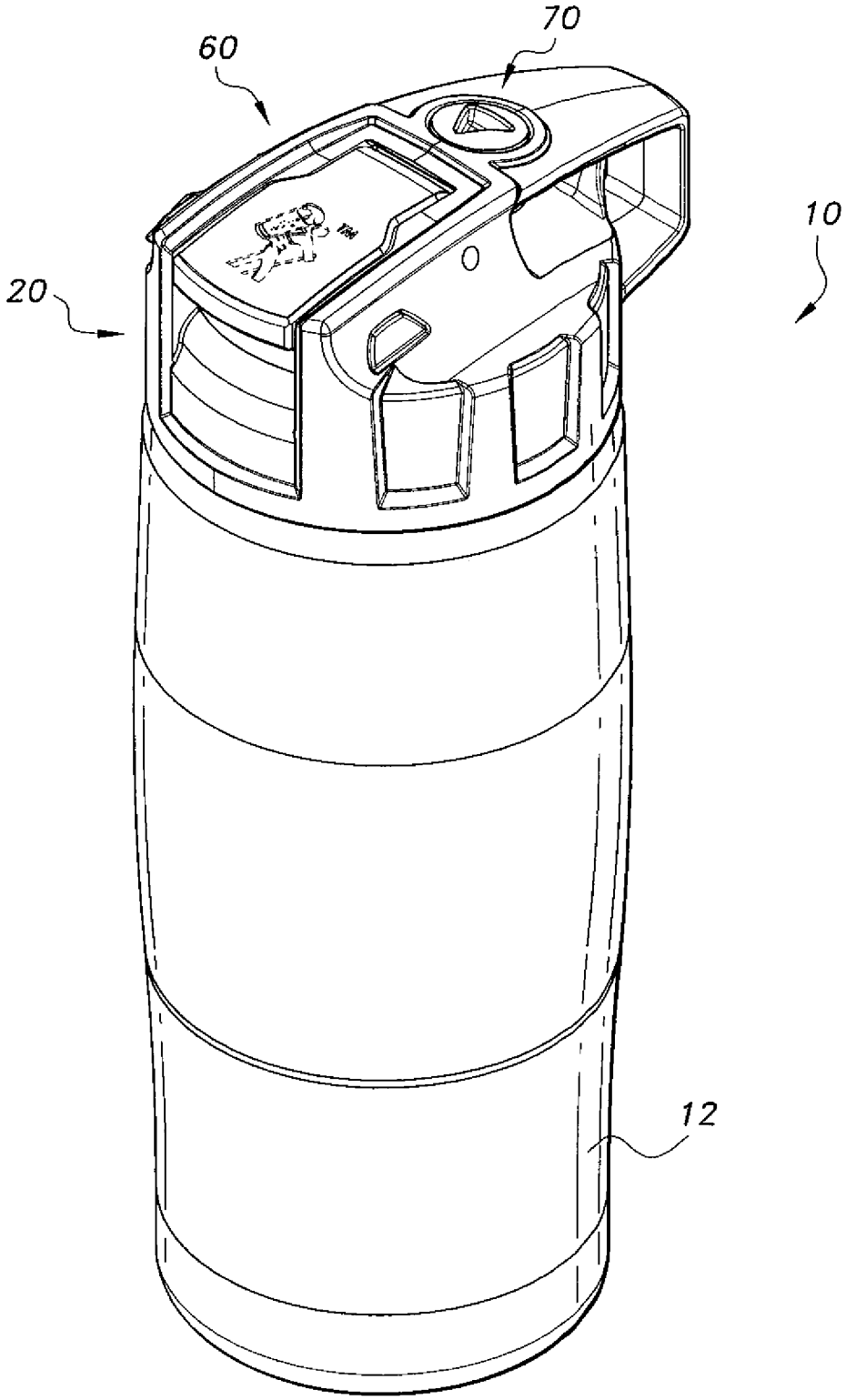
FIG. 1 is an environmental perspective view of a first embodiment of a carbonation device according to the present invention.
Figure 2:
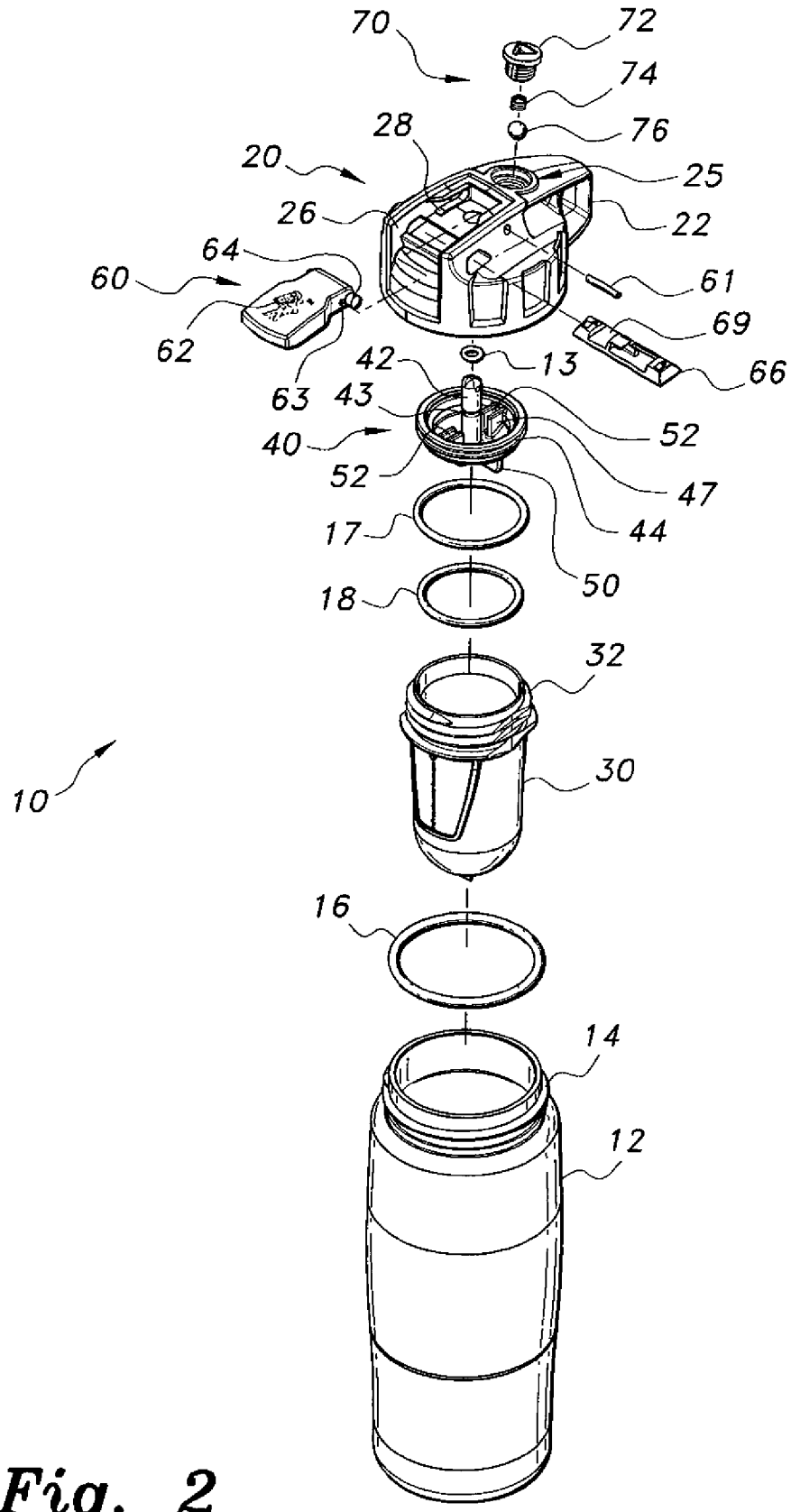
FIG. 2 is an exploded view of the carbonation device of FIG. 1.
Figure 3:
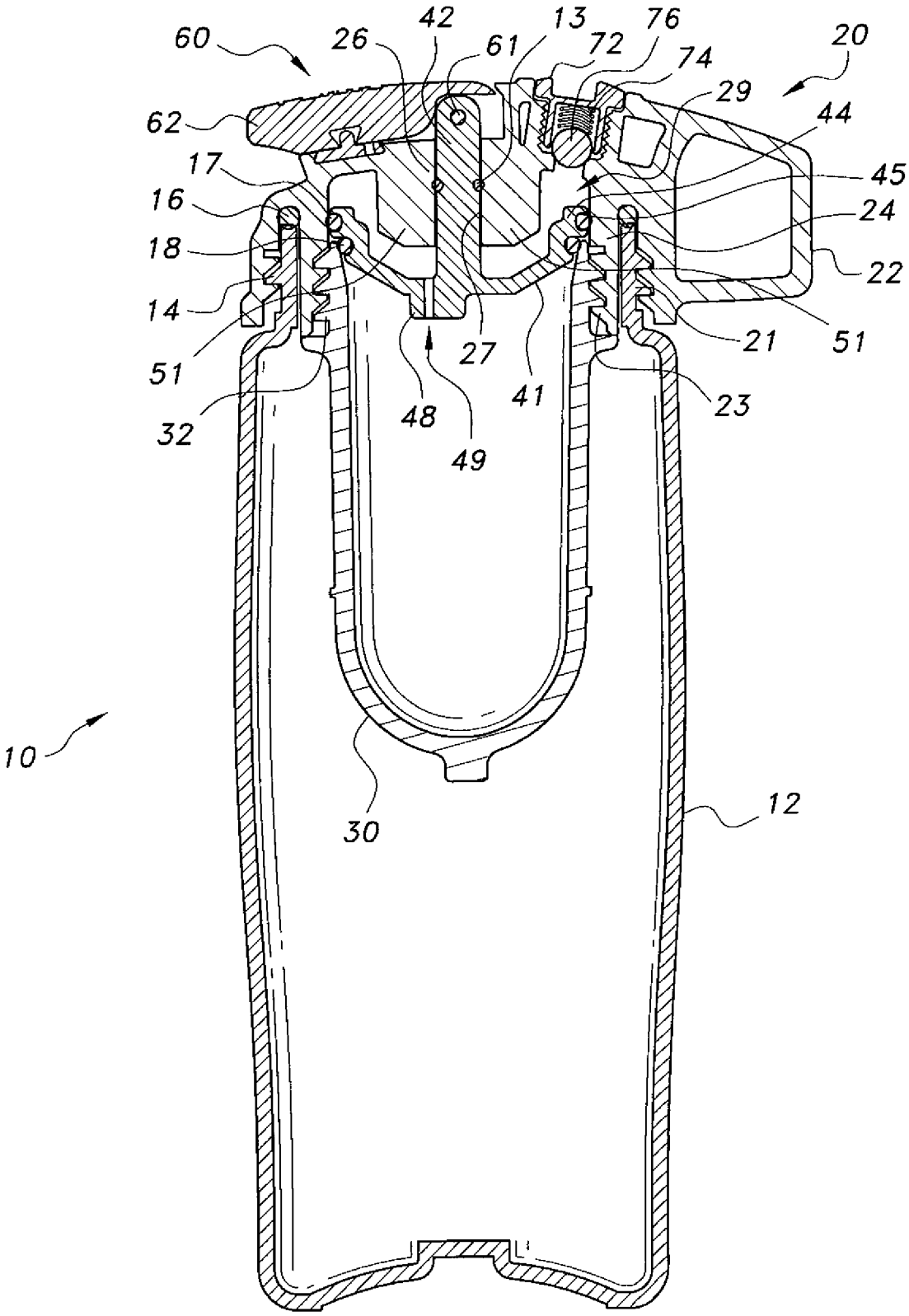
FIG. 3 is an elevation view in section of the carbonation device of FIG. 1.

The carbonation device is a device for producing carbonated beverages on demand in an efficient manner. As shown in FIGS. 1-3, in a first embodiment, the carbonation device 10 includes a cap 20 adapted to be mounted to a liquid container or water bottle 12 via threads. A carabiner loop or handle 22 extends from one side of the cap 20 for ease of transport or attachment to a backpack. The cap 20 includes a substantially hollow cylindrical body having internal threads 21 on the cap 20 that are adapted for mating with external threads 14 on the container 12. A concentric annular wall 24 is disposed inside the cap 20 and includes a plurality of internal threads 23 for mounting a reaction vessel or cup 30 with mating threads 32. The carbonation device 10 utilizes an endothermic reaction to produce carbonating gas, i.e. $CO_2$, within the reaction vessel 30. The gas feeds into the liquid, fluid or beverage to be carbonated from the reaction vessel 30 through the threads 32 towards the interior of the container 12. The threads 32 preferably do not extend continuously around the reaction vessel 30. Instead, the threads 32 are configured to have gaps or less restricted passages for gas or $CO_2$ to flow from the reaction vessel 30 into the container 12. To insure an airtight seal of the cap 20 during the carbonation process, a first O-ring 16 is disposed between the cap 20 and the container 12.

The reaction chamber or vessel 30 may be a substantially hollow body having a dome-shaped closed end and an opposite open end. The outer surface of the reaction vessel 30 may also include grip-enhancing protrusions to assist in handling and mounting. Various types of grip enhancing features may also be included. Moreover, the reaction vessel 30 is preferably made from plastic or other durable materials that can withstand the pressures experienced by the reaction vessel 30 in a safe manner. Similar materials are applicable to the container 12.

In order to produce the $CO_2$ for carbonation, the reaction vessel 12 is filled with a predetermined amount of carbonating material, such as sodium bicarbonate and citric acid, either in powder or tablet form. By mixing the sodium bicarbonate and citric acid with water, carbonating gas, such as $CO_2$, may be formed therein and distributed. The water is supplied by a syringe piston 40, which serves as both a means of delivering water to the reaction vessel 30 and as a valve for delivering the $CO_2$ to the container 12. In general, the supplied water reacts with the carbonating material pressurizing the reaction vessel 30. Once pressure has been built to a desired level, the syringe piston 40 is raised from the top of the reaction vessel 30 to open a passage for the gas to escape into the container 12.

Figure 4:
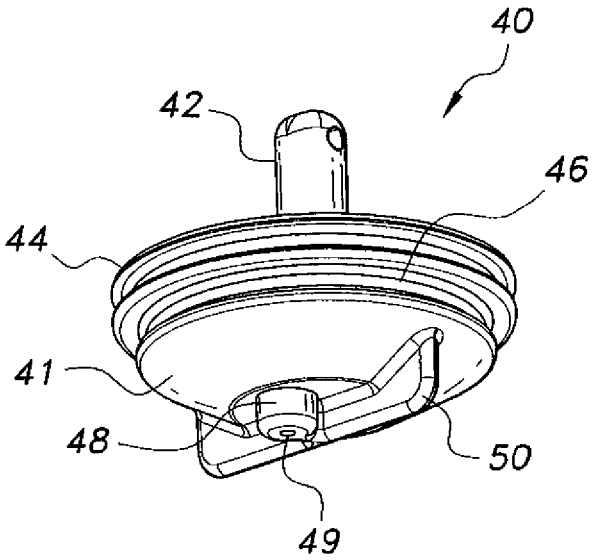
FIG. 4 is a bottom perspective view of the syringe piston in the carbonation device of FIG. 1.

As shown in FIGS. 2-4, the syringe piston 40 is configured as a bowl or cup 41 for holding water therein. It should be recognized that the configuration of the bowl 41 is not limited to just water. The bowl 41 may also hold and transfer gases. The bowl 41 may be shaped in a variety of ways to accommodate the specific volume of material to be moved or held by the syringe piston 40. The bottom of the bowl 41 includes outwardly extending ribs or walls 50, serving as a handle for installation thereof. An actuating mechanism, which will be further detailed below, reciprocates the syringe piston 40 within the cap 20. A shaft or rod 42 centrally disposed on the syringe piston 40 rides or slides within a central bore 27 on the cap 20. Thus, the bore 27 defines the path of travel for the syringe piston 40. The shaft 42 includes an annular groove 43 where a shaft O-ring 13 may be inserted to provide an airtight and watertight seal in the bore 27 during reciprocation of the syringe piston 40.

The syringe piston 40 also includes additional seals to provide a pressure-tight seal. A radially extending flange 44 at the top of the syringe piston 40 includes an annular groove or channel defined therein for a second, relatively large diameter O-ring 17. A third, smaller O-ring 18 is preferably disposed below the flange 44 within the annular groove or channel 46 such that when the reaction chamber is threaded to the bottom of the cap 20, and the syringe piston 40 is plunged downward, the third O-ring 18 seals against the open end of the reaction vessel 30 and closes the reaction vessel 30 off from the beverage container, thereby stopping the flow of $CO_2$ gas into the beverage. Thus, the third O-ring 18 may also be referred to as a valve ring. Alternative arrangements may be possible with the third O-ring 18, depending upon the geometry and location of the reaction vessel $CO_2$ exhaust ports. In the preferred embodiment, the entire open end of the reaction cup becomes the required sealing surface to close the flow of $CO_2$ gas from entering the beverage. However, other $CO_2$ exhaust path mechanisms, such as a centrally disposed straw, may require corresponding resizing and repositioning of the third O-ring 18.

During operation of the syringe piston 40, the syringe piston 40 may tend to rotate from the frictional contact with the O-rings 17 and 18. If left unchecked, this action tends to place rotational strain on the connection between the syringe piston 40 and the actuating mechanism, which may lead to structural failure or deformation. As shown in FIGS. 2 and 3, the carbonation device 10 includes an anti-rotation assembly preventing the syringe piston 40 from rotating. In FIG. 2, the interior of the bowl 41 includes a pair of spaced diametrically extending fins, ribs or walls 47 extending from opposed sides of the shaft 42. The spacing between each set of fins 47 forms an anti-rotation slot 52. The central column 26 includes a pair of radially extending anti-rotation fins, ribs or walls 51 (FIG. 3) that slidably fit within the respective anti-rotation slots 52. This connection insures that the syringe piston 40 reciprocates vertically and will not rotate. In addition to forming an anti-rotation assembly, the anti-rotation fins 47 also reinforce the walls of the bowl 41 and thereby maintain the shape of the bowl or cup 41.

The bottom of the syringe piston 40 also includes a downwardly extending post or bushing 48 having a through bore or port 49. The port 49 permits transfer of fluid or gas between the reaction vessel 30 and the bowl 41.

Figure 5:
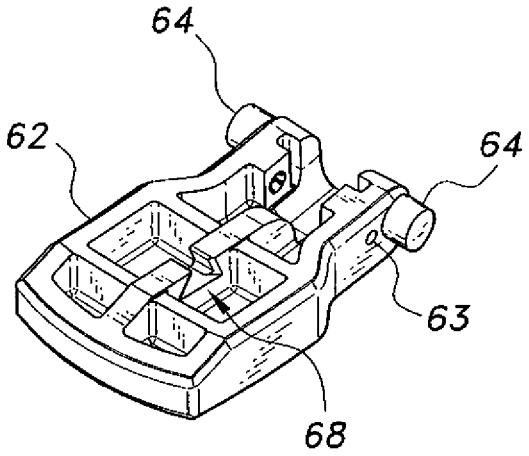
FIG. 5 is a bottom perspective view of the lever on the carbonation device of FIG. 1.

As shown in FIGS. 2, 3 and 5, the actuating mechanism 60 may include a cam lever 62 disposed within a recess 26 on top of the cap 20. The lever 62 is pivotally connected to the piston shaft 42 via a pin, bar or rod 61. The pin 61 is threaded through corresponding bores 63 on the lever 62 and a pivot bore on the piston shaft 42. The lever 62 includes at least one follower 64 adjacent the bore 63. The follower(s) 64 rides in corresponding cam channels, grooves or slots 28 disposed within the recess 26. The follower(s) 64 also defines the pivot axis of the lever 62. Selective operation of the lever 62 up or down results in corresponding raising or lowering motion of the syringe piston 40. Since the central bore 27 limits the shaft movement vertically, the action of the follower(s) 64 and cam channels 28 ensure that movement of the pivotal connection between the lever 62 and the shaft 42 is also limited vertically due to the pivot axis being variable during the operation of the lever 62. Although the above is a preferred exemplary embodiment, other alternative mechanical mechanisms that provide mechanical advantage for moving the syringe piston 40, such as a four-bar linkage or a threaded rotational actuating cap, may also be used.

The actuating mechanism 60 may also include a locking assembly for keeping the lever in the inoperative or down position, especially for transport. Another main aspect for the locked position is that the locked position seals the syringe piston 40 against the top of the reaction vessel 30 whenever needed, i.e., the locked position closes the valve. The locking assembly includes a slidable locking bar, rod or beam 66 received in correspondingly spaced mounting slots 67 formed in the recess walls of the recess 26. The locking bar 66 may be an elongate beam having a substantially trapezoidal shape in cross section. A central rib on the bottom of the lever 62 includes a locking slot 68 corresponding to the cross-sectional shape of the locking bar 66 to form a dovetail join when the locking bar 66 is in the locked position. To release the lock, the user slides the locking bar 66 until an unobstructed zone 69 mates with the locking slot 68, where the dovetail join cannot form. In this position, the lever 62 is free to move. Other alternative locking mechanisms, such as latches or spring locks, are also viable alternatives.

During operation of the carbonation device 10, the interior pressure may at times require release. In that regard, the carbonation device 10 includes a pressure relief valve 70 disposed in the recess 26 on top of the cap 20 adjacent the actuating mechanism 60. The pressure relief valve 70 includes an elastomeric ball 76 covering a relief hole or bore 29. The ball 76 is held in place by the combined action of the biasing means, such as a spring 74 and a nut 72 threaded into the recess 26. The spring 74 holds the ball 76 against the bore 29 and is preferably configured to withstand a certain amount of pressure prior to having the ball 76 forcibly moved away from the bore 29 when the internal pressure overcomes the strength of the spring 74. Various springs, such as a clip spring or an elastomeric sleeve, are viable alternatives for the relief valve 70.

The following describes how to use the carbonation device 10. When a user desires to carbonate a beverage, the cap 20 is removed from the container 12 to remove the reaction vessel 30. The container 12 is filled with some water and the cap 20 replaced. The container 12 is turned upside down so that the water pools toward the cap 20. The lever 72 is then unlocked and pivoted up and down repeatedly to reciprocate the syringe piston 40. The reciprocation of the syringe piston 40 creates a vacuum that pulls the water into the cup 41 through the port 49. The cup 41 is completely filled when no more air bubbles escape through the port 49.

Once filled with water, the reaction vessel 30 is filled with a predetermined amount of carbonating reagents and mounted to the cap 20. The container 12 is then filled with the beverage to be carbonated, and the cap 20 is reattached. In the upright position, the lever 72 is cycled several times to dispense the water through the port 49. The water contacts the effervescent reagents within the reaction vessel 30 and triggers the start of the chemical reaction. After a short period of time, the lever 72 is placed in the up position to open the top of the reaction vessel 30, which permits flow of the carbonating gas from the reaction vessel 30 into the beverage. It is noted that during this operation, the configuration of the syringe piston 40 and the limited travel facilitated by the piston shaft 42 allows for only a fraction of the water to be dispensed into the reaction vessel 30 at a time. While it is possible to empty the full contents of the syringe piston 40 at one time with corresponding modifications of, inter alia, the syringe piston 40 and the reaction vessel 30, such a configuration may cause a difficult to control reaction with the carbonating reagents, i.e., the reaction and pressure buildup may be too rapid. To help prevent this type of occurrence, the carbonation production is staggered by using discreet amounts of water per cycle until all the water has been consumed. Thus, carbonation occurs over a longer period of time for a more even and thereby efficient consumption and absorption of the gas into the beverage.

As naturally occurs, the gas production reaches equilibrium where carbonation is at a minimum. At this point, the user operates the lever 72 into the down position, closing the reaction vessel 30. The user then locks the lever 72 and shakes the carbonation device 10 vigorously for a short time. This agitation serves two purposes. The first purpose results in increased production of carbonating gas by increasing the reaction between the reagents. The second purpose results in forcing the remaining gas in the container 12 to be absorbed into the beverage due to the beverage moving inside the container 12. Both result in optimizing carbonation of the beverage.

When the newly generated $CO_2$ reaches a desired pressure level, the lever 72 can be raised to the up position to thereby open the top of the reaction vessel 30 and allow the gas to escape into the beverage. The above is repeated until the beverage has been carbonated to the user's satisfaction.

Thus, it can be seen that the carbonation device 10 is a compact, efficient apparatus for producing carbonated beverages on demand. The syringe piston 40 performs all the functions necessary for producing and delivering the carbonating gas in an efficient and relatively simple manner. The construction of the carbonation device 10 also permits easy assembly and disassembly for storage, travel and cleaning.

Figure 6:
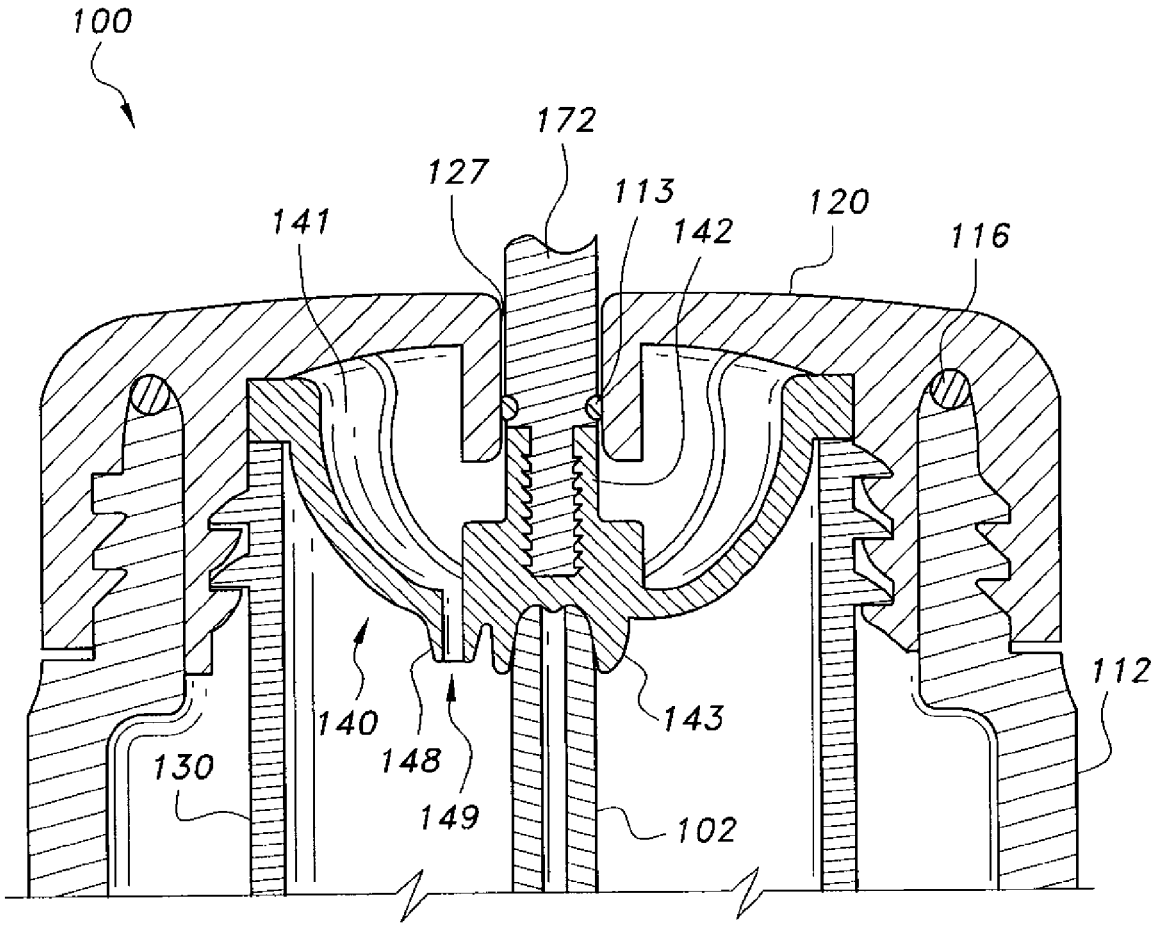
FIG. 6 is a partial environmental elevation view in section of an alternative embodiment of a carbonation device according to the present invention.

The above exemplary embodiment utilizes a relatively stiff syringe piston 40. However, a more flexible one may be used to obtain similar results. As shown in FIG. 6, the alternative carbonation device 100 is substantially the same as the carbonation device 10. The carbonation device 100 includes a cap 120 adapted to be mounted to the container 112 and a reaction chamber or vessel 130 is mounted below the cap 120. An O-ring 116 seals the connection between the cap 120 and the container 112.

Instead of a relatively stiff syringe piston, the carbonation device 100 includes a flexible diaphragm syringe piston 140. The diaphragm syringe piston 140 includes a bowl or cup 141 and a central piston rod or shaft 142 attached to an actuating rod or shaft 172 via threads or locking barbs. An O-ring 113 surrounds the actuating shaft 172 to seal reciprocation within the central bore 127 on the cap 120. The bottom of the diaphragm syringe piston 140 includes a downwardly extending post or bushing 148 having a throughbore or port 149. The port 149 permits transfer of fluid or gas between the reaction vessel 130 and the bowl 141. Moreover, a central flange 143 is formed at the bottom of the diaphragm syringe piston 140. The central flange 143 includes a recess for receiving one end of a distribution tube or straw 102. The other end of the distribution tube 102 opens into the interior of the container 112. As an alternative, the carbonation device 100 may include a include a lancing mechanism to facilitate use of a $CO_2$ cartridge.

In most respects, the carbonation device 100 operates substantially the same as the carbonation device 10. However, reciprocation of the actuating shaft 172 flexes the diaphragm syringe piston 140, creating vacuum and a pumping action for intake and discharge of fluid or gas. When carbonating gas is produced and the pressure builds, the pressure inside the reaction vessel 130 lifts the central flange 143, permitting $CO_2$ to escape through the distribution tube 102 into the beverage contained in the container 112.

Another alternative embodiment of the carbonation device is shown in FIGS. 7-10. The carbonation device 200 is a universal type that uses reagents or $CO_2$ cartridges. As shown, the carbonation device 200 includes a cap 220 adapted to be selectively mounted to a liquid container or water bottle 212; a control ring, valve or manifold 240 coaxially mounted and rotatable with respect to the cap 220; a reaction chamber, container or vessel 260 detachably mounted to the bottom of the cap 220; and a carbonating gas distribution tube or straw 272 or $CO_2$ cartridge 274 detachably mounted to the bottom of the cap 220 adjacent the reaction vessel 260. Various ports and vents in the cap 220 and the control ring 240 align with each other at preselected rotated positions of the control ring 240 for each stage of the carbonation process.

Figure 8:
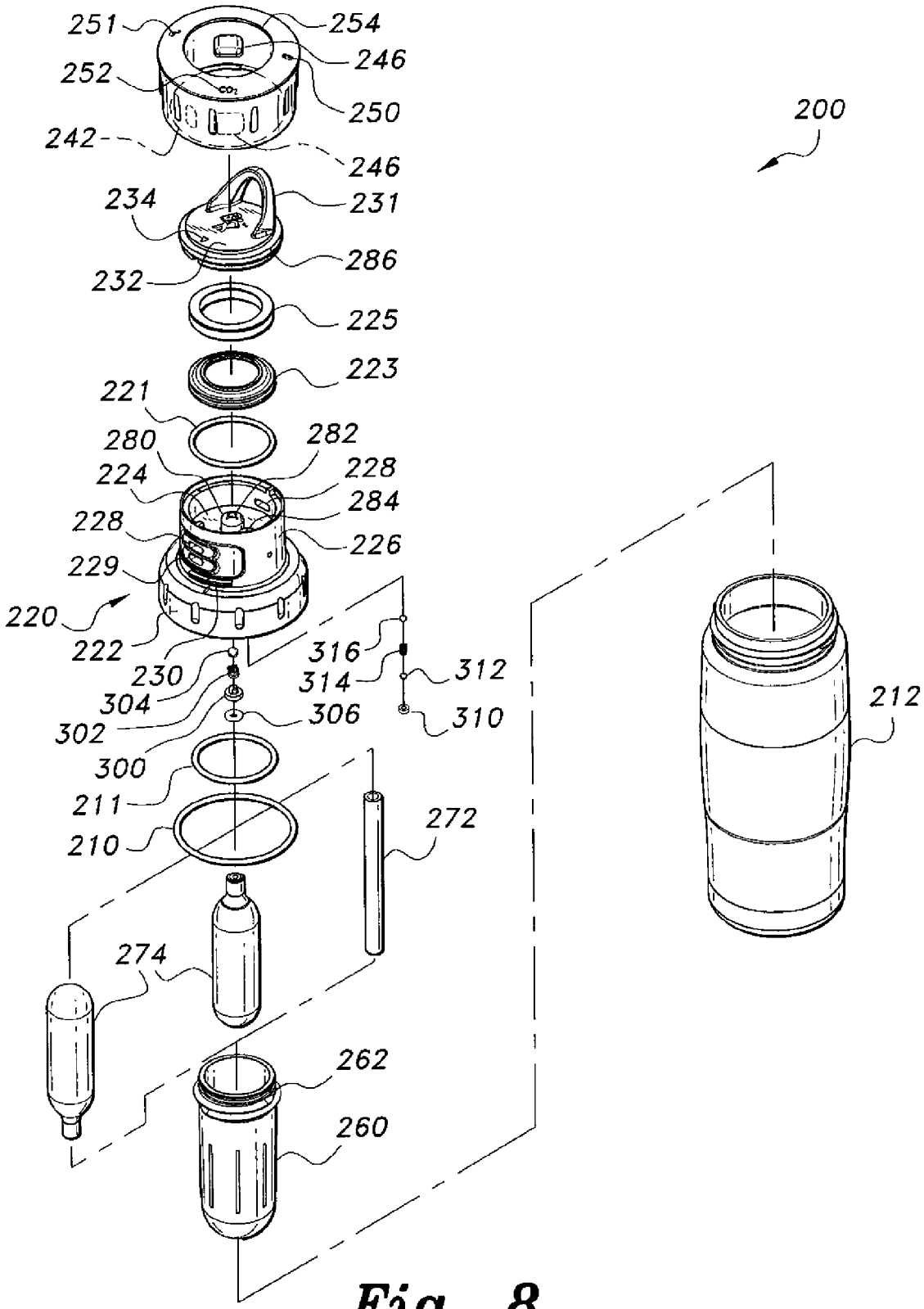
FIG. 8 is an exploded view of the carbonation device shown in FIG. 7.

Turning to FIG. 8, the cap 220 includes a tiered or telescoping cylindrical body having an upper, first body portion 226 and a lower, second body portion 222. The first body portion 226 has a smaller diameter than the second body portion 222. The larger diameter second body portion 222 forms a ledge upon which the control ring 240 may be mounted and rotated. The outer edge of the second body portion 222 may include indentions, protrusions or other grip enhancing features. The second body portion 222 forms a substantially annular ring with internal threads 224 for mounting the cap 220 onto the container 212 via corresponding threads 214. This connection is sealed by a first O-ring 210. The cap 220 also includes internal threads 218 inside the first body portion 222 adapted to mate with matching threads 262 on the reaction vessel 260. A second O-ring 211 provides a pressure-tight seal between the cap 220 and the reaction vessel 260.

The first body portion 222 includes a partition 224 separating the interior of the first body portion 222 into an upper chamber and a lower chamber. A pair of diametrically disposed upper ports, vents or holes 228 are formed on the upper chamber portion of the first body portion 222. These upper vents 228 permit flow of fluid or gas into the upper chamber.

Below each upper vent 228 is a corresponding lower port, vent or hole 229 that permits flow of fluid or gas through the lower chamber.

The control ring 240 is rotatably mounted to the first body portion 226 of the cap 220. The control ring 240 may be a cylindrical body having a smaller diameter open top 254. To facilitate secure operative engagement therebetween, the control ring 240 includes discontinuous interior flanges or tabs 242 projecting radially inwardly from near the bottom of the interior of the control ring 240. These tabs 242 include locking notches or indentions that are disposed in the internal annular groove or channel 244 at predefined positions around the inner circumference of the control ring 240. Each notch indention corresponds to a selected control position for operation of the carbonation device 200. The first body portion 226 includes at least two rotation tabs 230 extending radially outwardly from the exterior surface of the first body portion 226. Each rotation tab 230 includes a locking protuberance 231 engageable with the above-mentioned locking indentions in the control ring 240 when assembled. The interaction between the locking protuberances 231 and the locking indentions locks the relative positions of the control ring 240 about the cap 220 for select operations of the carbonation device 200.

Figure 7:
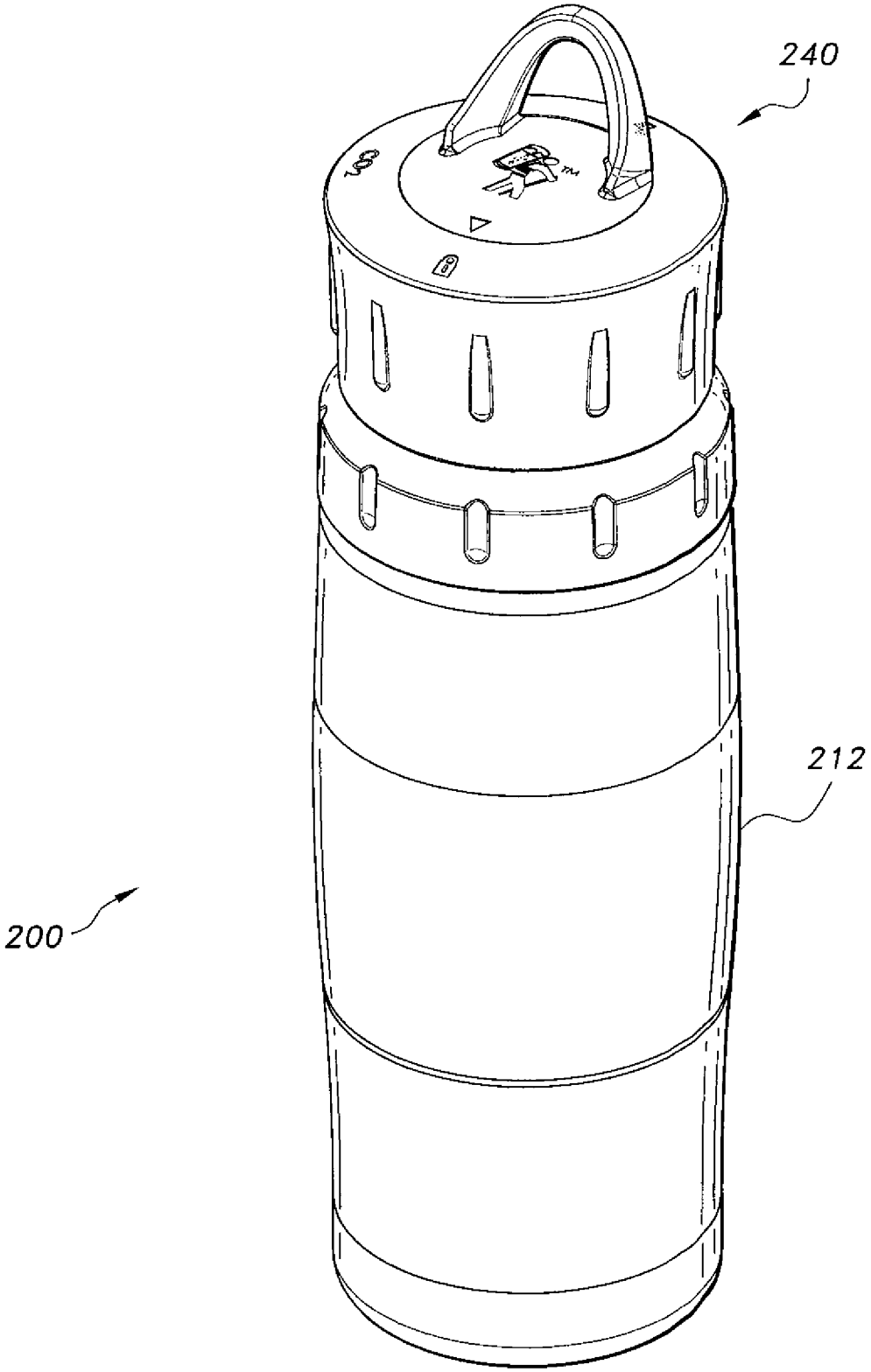
FIG. 7 is an environmental perspective view of another alternative embodiment of a carbonation device according to the present invention.

The interior of the control ring 240 also includes a pair of diametrically opposed control grooves or vents 246 that align and communicate with the upper vents 228 and the lower vents 229 when the control ring 240 is rotated to a select position. As shown in FIGS. 7 and 8, the top portion of the control ring 240 includes a plurality of indicia 250-252. The indicium 250 refers, e.g., to an "unlocked" position in which the control ring 240 can be removed from the cap 220 for cleaning purposes. The indicium 251 refers, e.g., to the "$CO_2$" position, which aligns the control grooves 246 with the upper and lower vents 228 and 229. The indicium 252 refers, e.g., to a "locked" position in which the upper and lower vents 228 and 229 are blocked so that the carbonation device 200 can be transported or for shaking the carbonation device 200.

As shown in FIG. 8, the upper chamber of the cap 220 is open. To cover the same, the carbonation device 200 includes a vertically movable top cover 232 that, when assembled, forms an enclosed upper chamber. The cover 232 includes a radially extending circular flange 236 abutting the underside of the top portion of the control ring 240, which prevents the same from falling out of the control ring 240. A sealing ring 225 on top of an annular spring 223 insures a pressure-tight seal. An intermediate control plate or piston 238, the function of which will be further explained below, includes a downwardly extending protrusion, extension or button 239. The control plate 238 is disposed between the cover 232 and the top of the upper chamber in the cap 220. The cover 232 also includes a pointer indicium 234, which serves as a guide for selectively positioning the control ring 240 at the desired position. This is facilitated by aligning the respective indicia 250-252 with the pointer indicium 234. The cover 232 may include a carabiner ring or loop 231 for transport or attachment to a backpack.

To regulate pressure and distribution of fluid or gas, the carbonation device 200 may include several pressure relief valves. The first pressure relief valve is formed at the center of the partition 224. A first relief valve housing 280 extends through the center of the partition 224. The upper half of the first relief valve housing 280 includes an opening 282 through which gas may escape into the upper chamber. The upper half houses a ball 304 biased against the opening 282 by a spring 302. The lower half of the valve housing 280 includes a hollow lance or spear 300 with a point for piercing the nipple of a $CO_2$ cartridge 274.

The lance 300 is shaped like a flanged bushing with the pointed end disposed towards the interior of the reaction vessel 260 or the container 212. The flanged portion of the lance 300 abuts against a stepped portion of first relief valve housing 280 on one side. A retention O-ring 306 helps to retain the lance 300 within the first relief housing 280, as well as sealing the interior for optimum flow of medium. As previously mentioned, the lance 300 is hollow and includes a bore or passage 301 permitting the flow of medium between the upper and lower chambers of the cap 220. Pressure is relieved either by forceful uncovering of the opening 282 by the button 239 pressing down on the ball 304, or by lessening of the interior pressure over time. The relief over time releases some of the compression on the spring 302 via the lance 300, which consequently permits the ball 304 to lower and uncover the hole or port 282.

A second pressure relief valve housing 284 is disposed adjacent the first relief valve housing 280. The second pressure relief valve housing 284 encloses balls or obstructions 312, 316 disposed on opposite sides of a spring 314. The spring 314 and the balls 312, 316 are retained within the second relief valve housing 284 by a retention sealing ring 310. As an alternative, a third pressure relief valve may be disposed at the bottom of the reaction vessel 260 to selectively relieve pressure therein. The third pressure relief valve may be of similar construction to the first relief valve.

Figure 9:
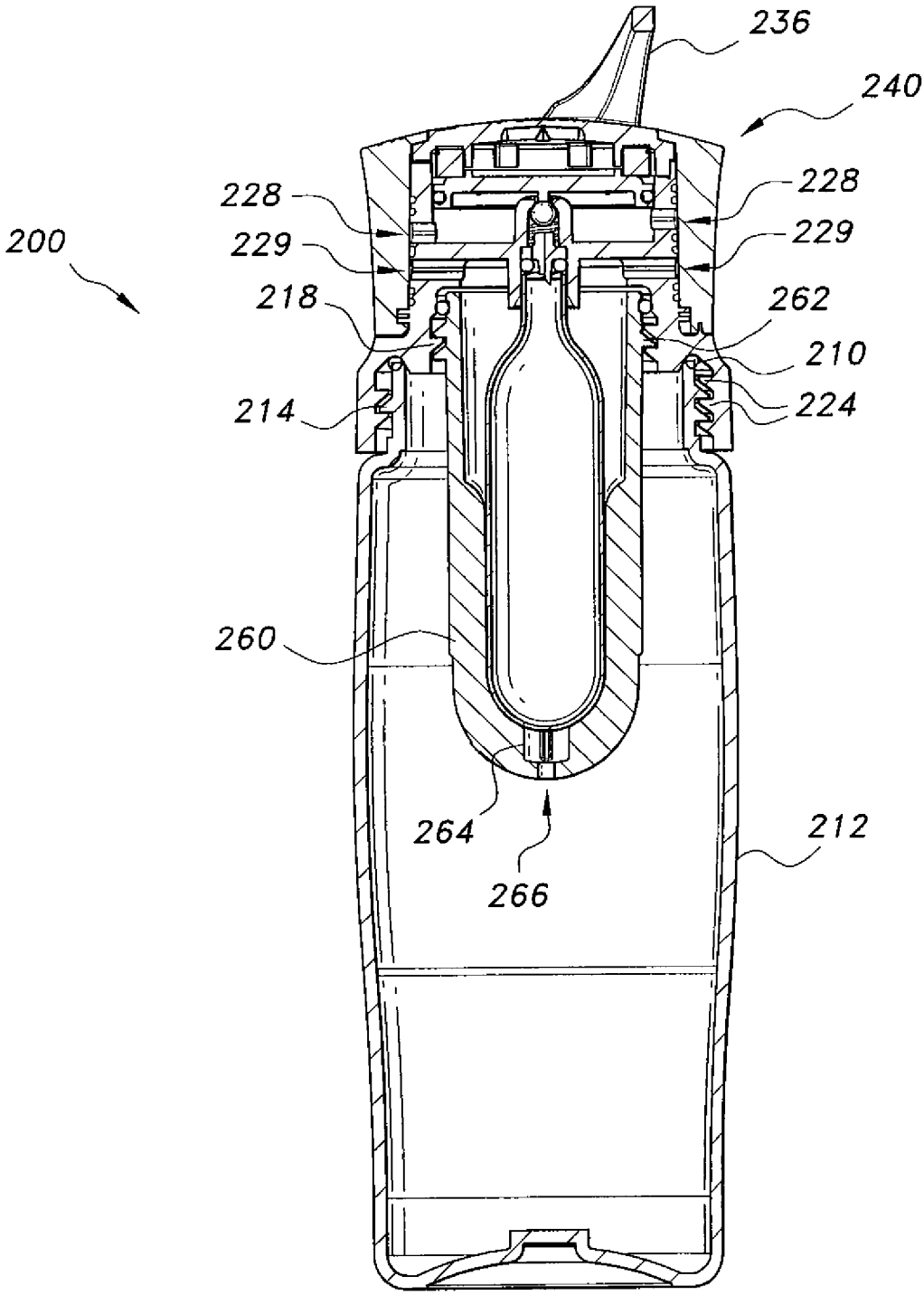
FIG. 9 is an elevation view in section of the carbonation device shown in FIG. 7.
Figure 10:
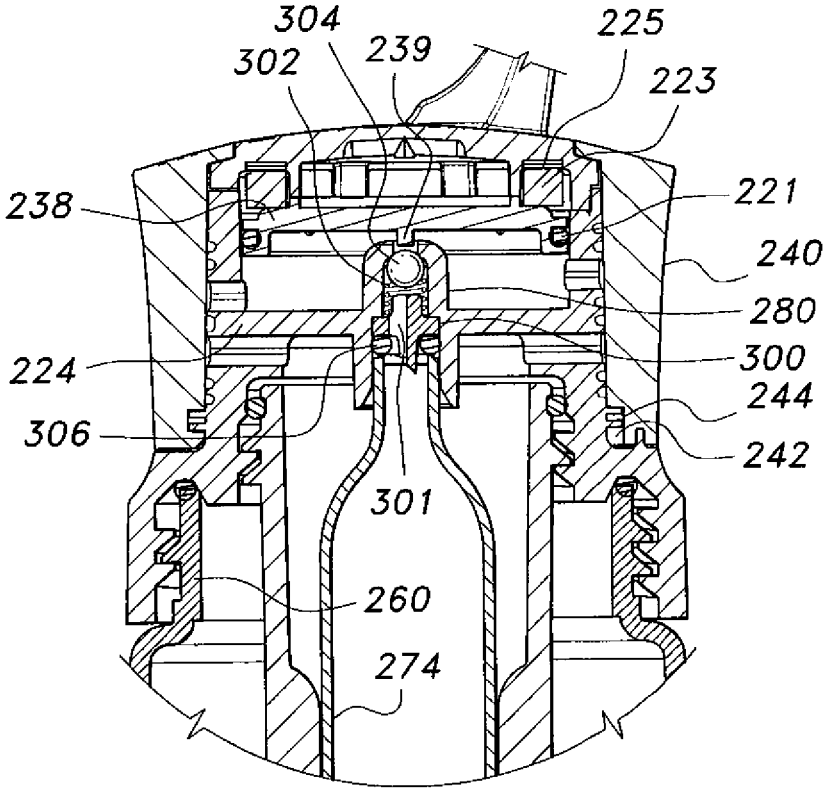
FIG. 10 is a partial elevation view in section of the carbonation device shown in FIG. 9.

As mentioned, the universal carbonation device 300 utilizes carbonating gas either from reagents or from a $CO_2$ cartridge 274. Both are facilitated through the reaction vessel 260. As shown in FIGS. 8 and 9, the reaction vessel 260 includes a mounting recess 264 in communication with a vent, port or hole 266, through which carbonating gas exits into the interior of the container 212.

When the cartridge 274 is to be used, the cartridge 274 may normally be stored upside down so that the nipple of the cartridge 274 is mounted inside recess 264. When using reagents, a distribution tube 272 is installed inside the reaction chamber 260 with one end attached to the lower portion of the first relief valve housing 280 and the other end attached to the mounting recess 264.

The following describes how to use the universal carbonation device 200 using either carbonating source. In the first example, using the cartridge 274, the user rotates the control ring 240 into the "locked" position to facilitate insertion of the cartridge 272. The cap 220 is threaded onto the reaction vessel 260 forcing the nipple of the cartridge 274 to move towards the lance 300 and be pierced thereby. Then the cap 220 is attached to the container 212. The $CO_2$ gas exits the cartridge and travels through the lance 300 and the first pressure relief valve housing 280. Then the gas enters the upper chamber under the piston 238. The pressure within this region increases until the pressure generates enough force to lift the piston 238 against the opposing force of the spring 223 above. When the piston 238 lifts, this action releases the ball 304, allowing the ball 304 to seal against the port 282. At this point, pressure is permitted to build.

To initiate carbonation of the beverage in the container 212, the user rotates the control ring 240 into the "$CO_2$" position aligning the vent control grooves 246 with the upper and lower vents 228 and 229. The gas trapped in the upper chamber flows through the upper vents 228 into the lower vents 229 towards the lower chamber. From there, the gas exits through the exhaust port 266 to carbonate the beverage.

As the gas exits the upper chamber, pressure is reduced therein. Since the annular spring 223 normally biases the piston 238 towards the first relief valve housing 280, the button 239 eventually presses down on the ball 304 to unseal the port 282. This permits residual pressure inside the cartridge 274 to transfer the remaining gas inside the cartridge 274. The user may shake the carbonation device 200 to force carbonate the beverage for substantially the dual purposes discussed above. When the desired carbonation has been reached, the beverage is ready to be enjoyed.

When using reagents, the user initially places the cap 220 upside down with the control ring 240 in the "$CO_2$" position, aligning the vent control grooves 246 with the upper and lower vents 228 and 229. The interior of the cap 220 forms a funnel, to which the user may add water so that the water accumulates into the upper chamber. Once the upper chamber has been filled, the control ring 240 is rotated to the "locked" position, trapping the water in the upper chamber.

The reaction vessel 260 is filled with a predetermined amount of carbonating reagents, such as citric acid and sodium bicarbonate, and then attached to the cap 220. The whole assembly is then mounted to the container 212 that has been filled with the beverage to be carbonated. Once firmly attached to the container 212 and the distribution tube 272 is reattached, the control ring 240 is again rotated to the "$CO_2$" position, releasing the trapped water into the reaction vessel 260. The water and the reagents initiate production of carbonating gas.

The produced gas leaves the reaction chamber 260 through the lower vents 229 and into the upper chamber via upper vents 228. Since the annular spring 223 normally presses down on the piston 238, releasing the ball 304 and unsealing the port 282, the gas flows through the lance 300 and the tube 272 into the beverage. As the interior pressure slowly decreases over time, the lessening pressure becomes less than the pressure from the spring 302, at which point the ball 304 seals the port 282.

The user may vigorously shake the carbonating device 200 for a brief period of time after rotating the control into the "locked" position. The shaking helps to recharge the carbonating reaction. Then the control ring 240 may be returned to the "$CO_2$" position to recommence distribution of the carbonating gas. The above may be repeated until the desired carbonation has been reached. Then the beverage is ready to be enjoyed.

As with the carbonation device 10, the alternative carbonation devices 100, 200 are compact, efficient apparatus for producing carbonated beverages on demand. The endothermic reaction provides some cooling to the beverage. Moreover, the construction of the alternative carbonation devices 100, 200 permits easy assembly and disassembly for storage, travel and cleaning.

Figure 11:
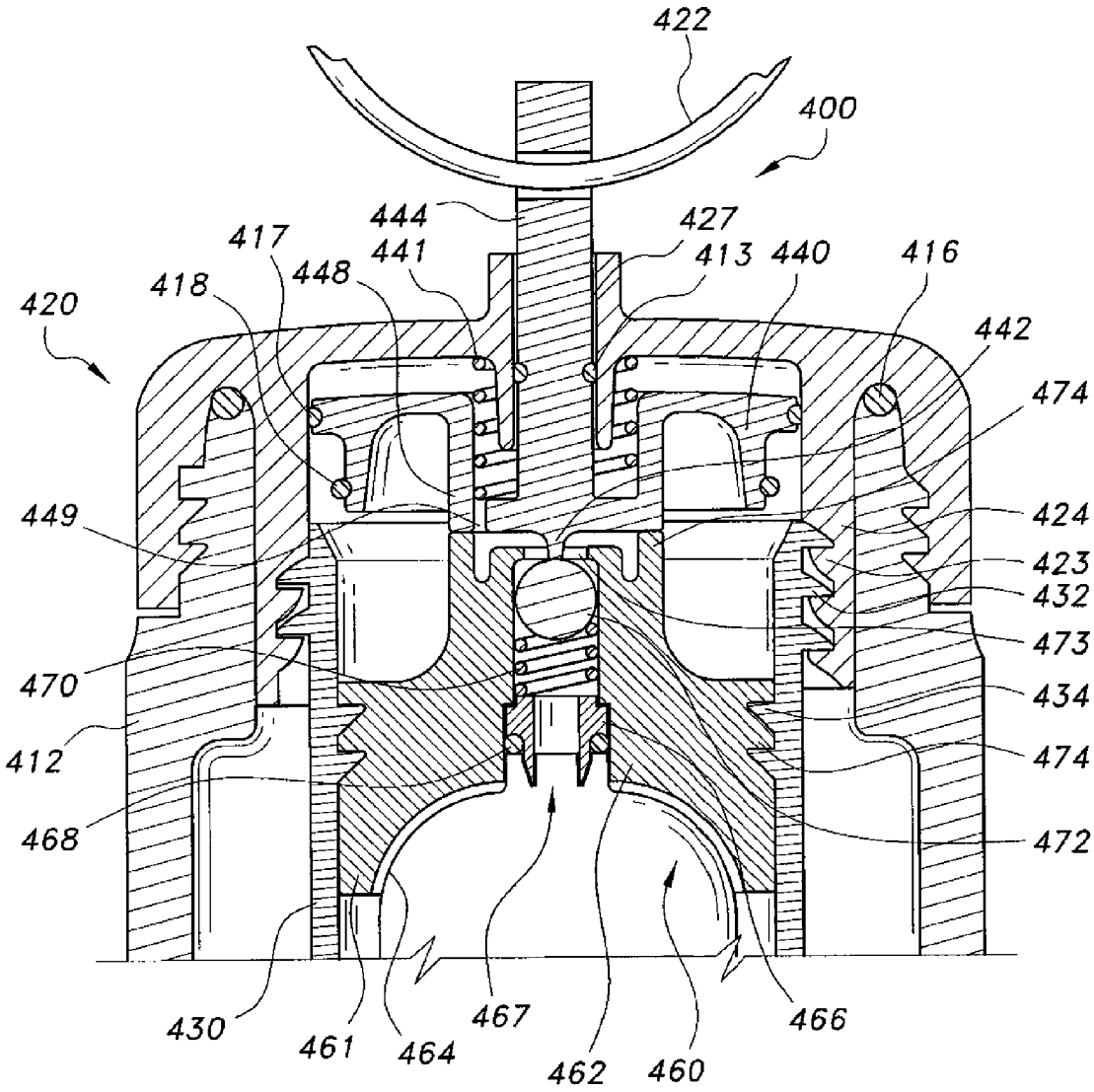
FIG. 11 is a partial environmental elevation view in section of another alternative embodiment of a carbonation device.

A further alternative carbonation device 400 is shown FIG. 11. This embodiment is a further example of a universal carbonation device using either carbonation reagents or a $CO_2$ cartridge including a separate lancing assembly.

As shown in FIG. 11, the carbonation device 400 includes a cap 420 adapted to be selectively mounted to a liquid container or water bottle 412 via threads. A first O-ring 416 provides a pressure tight seal between the cap 420 and the container 412. A concentric annular wall 424 is disposed inside the cap 420 and includes a plurality of internal threads 423 for mounting a reaction vessel or cup 430 with mating threads 432. As with the previous carbonation device 10, the threads 432 are configured with gaps or less restricted passages for gas or $CO_2$ to flow from the reaction vessel 430 into the container 412. The reaction vessel 430 may include a plurality of fins symmetrically oriented around the interior thereof. Moreover, the bottom of the reaction vessel 430 may include a recess similar to the recess 264 for securing a cartridge therein.

A reciprocating syringe piston 440 with a piston rod 444 reciprocates within a central bore 427 formed through the top of the cap 420 to selectively open or close the opening of the reaction vessel 430, i.e., a valve. The piston rod 444 is sealed from atmosphere by a piston seal O-ring 413. The bottom of the syringe piston 440 includes a downwardly extending post or bushing 448 having a through bore or port 449. The port 449 permits transfer of fluid or gas between the reaction vessel 430 and the upper portion of the syringe piston 440. A button 442 is formed adjacent the port 449, and the button 442 performs similar to the button 239. The carbonation device 400 includes a biasing means, such as the spring 441 disposed between the cap 420 and the bushing 448, to normally keep the syringe piston 440 in the down position, sealing the reaction vessel 430. The strength of the spring 441 is predetermined such that pressure from the reaction vessel 430 may move the syringe piston 440 to open the valve during the carbonation process. The bushing 448 and the upper portion of the syringe piston 440 define a bowl for storage and transfer of fluids and gases, as in the previous embodiments. The syringe piston 440 also includes a second, relatively large diameter O-ring 417 and a third, smaller diameter O-ring 418 providing the required seals for the syringe piston 440. Reciprocation of the syringe piston 440 may be facilitated by using the handle ring 422. Moreover, the carbonation device 400 may include a locking mechanism to keep the syringe piston 440 in the down or "locked" position.

When using carbonation producing reagents, the cap 420, container 412, syringe piston 440 and the reaction vessel 430 operate substantially similar to the carbonation device 100. In most respects, the biased syringe piston 440 functions similarly to the flexible diaphragm syringe piston 140. However, when the syringe piston 440 is raised, either manually via the handle ring 422, or by increased pressure from the reaction vessel 430, so that the product gas flows from the reaction vessel 430 through the threads 432.

To use a cartridge in the carbonation device 400, the carbonation device 400 includes a lance valve assembly 460. The lance valve assembly 460 may be selectively attached to the interior of the reaction vessel 430 with matching external threads 474 on the lance valve assembly 460 and internal threads 434 in the reaction vessel 430. The lance valve assembly 460 includes a funnel-shaped body 461 having a central bore for installation of a ball 472, a spring 470, and a lance or spear 466. The lance 466 is retained in the bore by a retaining ring 468. The spring 470 biases the ball 472 against the opening or port 473 to normally close the port 473. The lance 466 includes a pointed end adapted to pierce the nipple of a cartridge and a bore or hole 467 permitting flow of gas from the pierced cartridge. The bottom of the body 461 is curved to conform with the shape of the cartridge, providing a secure mounting for the cartridge inside the reaction vessel 430. The upper portion of the body 461 includes an annular raised lip 474 extending upwardly a predetermined distance such that when the bottom of the syringe piston 440 rests thereon, a gap is maintained between the port 473 and the bottom of the syringe piston 440. In this manner, the gas is free to flow as long as the port 473 remains open. The raised lip 474 is configured to allow the flow of gas through the threads 432 by discontinuities or gaps around the lip 474.

In use, the cartridge is installed inside the reaction vessel 430. The lance valve assembly 460 is threaded inside the reaction vessel 430 to secure the cartridge therein and simultaneously pierce the nipple thereof with the lance 466. Once the reaction vessel 430 is secured to the cap 420 and the cap 420 secured to the container 412, the piston rod 444 is pressed down manually or by the strength of the spring 441 to move the ball 472 with the button 442.

As the gas is released from the cartridge, the gas increases internal pressure that eventually overcomes the force of the spring 441 and slowly raises the ball 472 and the syringe piston 440. In the meantime, the gas flows through the threads 432 to carbonate the beverage. Vigorous shaking or agitation and repetition of the above increases carbonating gas production and absorption till the desired level of carbonation has been reached.

It is to be understood that the carbonation devices 10, 100, 200, 400 encompass a wide variety of alternatives. For example, the carbonation devices 10, 100, 200 are preferably made from durable plastic, but other materials, such as aluminum, steel, composites, wood or any combination thereof, may also be used. In addition, threading and other components may be sized to fit a variety of bottles and containers. Moreover with respect to the carbonation device 200, the locations, shape and size of the various ports and vents in the cap 220 and the control grooves in the control ring 240 may be rearranged, so long as they can be aligned to form pathways for the water and carbonating gas. As a further alternative, the lance 300 may be incorporated into the carbonation devices 10, 100 in a similar manner as that shown in the carbonation device 400. Furthermore, the carbonation devices 10, 100, 200, 400 may include a variety of colors and indicia for aesthetic appeal, advertising, personal messaging or indicators of various components.

As a still further alternative to the above, a different kind of valve system may be used to collect and transfer water to a reaction vessel. For example, a rotatable trough may be used to collect a preselected amount of water in one position, and in another rotated position, dumps the water to a reaction vessel. Moreover, with respect to the carbonation device 200, the locations, shape and size of the various ports and vents in the cap 220 and the control grooves in the control ring 240 may be rearranged, so long as they can be aligned to form pathways for the water and carbonating gas.

It is to be understood that the present invention is not limited to the embodiments described above, but encompasses any and all embodiments within the scope of the following claims.

I claim:

1. A carbonation device, comprising:

a substantially hollow cap adapted to be mounted to an opening of a liquid container;

a reciprocating syringe piston slidably mounted on the cap, the syringe piston having a bowl for holding and dispensing water and gas;

an actuating mechanism mounted on the cap for selectively reciprocating the syringe piston;

a reaction vessel mounted on the cap, the reaction vessel being adapted to hold carbonating gas producing reagents to be mixed with the water, and a carbonating gas distribution system connected to the cap, the system dispensing the carbonating gas into liquid held in the liquid container;

wherein operation of the actuating mechanism creates a vacuum for drawing the water into the bowl, the water being dispensed into the reaction vessel to be mixed with the reagents and thereby produce carbonating gas for carbonating beverage inside the liquid container.

2. The carbonation device according to claim 1, wherein the cap includes a handle loop.

3. The carbonation device according claim 1, wherein said cap comprises first internal threads for mounting the cap onto the liquid container, the first internal threads having a diameter, and second internal threads concentric with the first internal threads, the second internal threads mounting said reaction vessel, the second internal threads having a diameter smaller than the first inner threads.

4. The carbonation device according to claim 1, wherein the syringe piston comprises:

an upwardly extending piston rod centrally disposed in said bowl, the piston rod having a pivot pin pivotally connected to said actuating mechanism; and a vent post formed at the bottom of said bowl, the vent post having a throughbore permitting flow of water or gas into and out of said bowl.

5. The carbonation device according to claim 4, wherein the syringe piston further comprises a plurality of reinforcing ribs in said bowl for maintaining shape of said bowl.

6. The carbonation device according to claim 5, wherein the syringe piston further comprises a plurality of handle fins integral to said bowl.

7. The carbonation device according to claim 1, wherein said cap has a recess defined therein, said actuating mechanism comprising:

a cam lever mounted in the recess in said cap, the cam lever having a portion thereof pivotally attached to said syringe piston;

at least one follower disposed on one end of the cam lever; and a cam channel formed in the recess in said cap;

wherein raising and lowering of the cam lever reciprocates said syringe piston.

8. The carbonation device according to claim 7, further comprising a locking mechanism for locking the cam lever in a lowered position.

9. The carbonation device according to claim 8, wherein the locking mechanism comprises:

an elongate locking bar extending perpendicular to said cam lever, said locking bar having a cross-sectional shape and a discontinuous section;

a pair of spaced mounting slots formed in said recess, said slots having a shape corresponding to the cross-sectional shape of said locking bar; and a central rib on said cam lever, the central rib having a slot, the slot having a shape corresponding to the cross-sectional shape of said locking bar;

wherein said locking bar is slidable in said mounting slots to a locked position where the cross-sectional shape of the bar mates with the shape of the slot in said central rib, forming a locking joint, and to an unlocked position where said discontinuous portion mates with the slot in said central rib.

10. The carbonation device according to claim 1, further comprising a pressure relief valve disposed on top of said cap.

11. The carbonation device according to claim 10, wherein said pressure relief valve comprises:

a ball received in a recess on said cap, the ball covering a vent hole;

an elongated spring biasing the ball against the vent hole at one end; and a nut disposed against the other end of the spring.

12. The carbonation device according to claim 11, further comprising a plurality of seals pressure-sealing said cap, said reaction vessel and said syringe piston.

* * * * *